US010815701B2

(12) United States Patent
Ilardo

(10) Patent No.: US 10,815,701 B2
(45) Date of Patent: Oct. 27, 2020

(54) SAFETY DEVICE FOR A VEHICLE DOOR HANDLE

(71) Applicant: U-Shin Italia S.p.A., Pianezza (IT)

(72) Inventor: Simone Ilardo, Pianezza (IT)

(73) Assignee: U-Shin Italia S.p.A., Pianezza (IT)

( * ) Notice: Subject to any disclaimer, the term of this patent is extended or adjusted under 35 U.S.C. 154(b) by 271 days.

(21) Appl. No.: 15/910,285

(22) Filed: Mar. 2, 2018

(65) Prior Publication Data

US 2018/0187456 A1 Jul. 5, 2018

Related U.S. Application Data

(63) Continuation of application No. PCT/EP2016/059971, filed on May 4, 2016.

(30) Foreign Application Priority Data

Sep. 2, 2015 (EP) ..... 15183509

(51) Int. Cl.
*E05B 77/06* (2014.01)
*E05B 85/16* (2014.01)

(52) U.S. Cl.
CPC ..... *E05B 77/06* (2013.01); *E05B 85/16* (2013.01)

(58) Field of Classification Search
CPC ..... E05B 77/06; E05B 77/04; E05B 77/02; E05B 77/00; E05B 85/16; E05B 85/14; E05B 85/00
USPC ..... 292/336.3
See application file for complete search history.

(56) References Cited

U.S. PATENT DOCUMENTS 8,746,758 B2 * 6/2014 Savant ..... E05B 77/06 292/336.3
2006/0038417 A1 * 2/2006 Pudney ..... E05B 13/002 292/336.3
2006/0163887 A1 * 7/2006 Savant ..... E05B 77/06 292/336.3

(Continued)

FOREIGN PATENT DOCUMENTS

DE 102009016898 9/2010
DE 102013203808 9/2014
EP 2325419 5/2011

OTHER PUBLICATIONS

International Search Report for International Application PCT/EP2016/059971, dated Jul. 7, 2016.

*Primary Examiner* — Nathan Cumar
(74) *Attorney, Agent, or Firm* — Burris Law, PLLC

(57) ABSTRACT

The present disclosure relates to a safety device for a vehicle door handle. The device includes an activation element configured to activate a latch by rotating from a rest position to an activation position and includes at least one activation protuberance. The device also includes a blocking element having first and second blocking protuberances and being configured to rotate between a disengaged position in which the blocking element allows the activation element to rotate, and first and second blocking positions in which the first or second blocking protuberance interact with the activation protuberance so as to block the activation element in a first or second intermediate positions disposed between the rest and activation positions of the activation element in case of a crash. The present disclosure further relates to the corresponding vehicle door handle and vehicle.

13 Claims, 2 Drawing Sheets

(56) References Cited

U.S. PATENT DOCUMENTS

| | | | | |
|---|---|---|---|---|
| 2014/0145454 | A1* | 5/2014 | Da Deppo | E05B 77/06 292/336.3 |
| 2015/0322699 | A1* | 11/2015 | Ilardo | E05B 77/06 292/336.3 |

* cited by examiner

SAFETY DEVICE FOR A VEHICLE DOOR HANDLE

CROSS-REFERENCE TO RELATED APPLICATIONS

This application is a continuation of International Application No. PCT/EP2016/059971, filed on May 4, 2016, which claims priority to and the benefit of EP 15183509.7 filed on Sep. 2, 2015. The disclosures of the above applications are incorporated herein by reference.

FIELD

The present disclosure relates to a safety device for a vehicle door handle, as well as a vehicle comprising such a safety device.

BACKGROUND

The statements in this section merely provide background information related to the present disclosure and may not constitute prior art.

Motor vehicle safety standards require that the doors of the vehicle stay closed in case of a collision, also called a "crash."

To meet these requirements, known safety devices comprise:

an activation element configured to activate a latch by rotating around an activation axis from a rest position to an activation position, the activation element comprising at least one activation protuberance, a blocking element comprising a blocking protuberance and being configured to rotate around a blocking axis between:

a disengaged position in which the blocking element allows the activation element to rotate around the activation axis from a rest position to an activation position; and a blocking position in which the blocking protuberance interacts with the activation protuberance so as to block the activation element in an intermediate position disposed between the rest and activation position of the activation element in case of a crash.

The blocking element comprises an inertial mass and a blocking part, wherein the blocking part is configured to intercept a stop of the activation element during a collision.

However, in some specific circumstances, the blocking element may not be able to block the blocking element, due to a delay in the rotation of the blocking element in case of high acceleration.

SUMMARY

The present disclosure provides a safety device that is simple, not expensive, and more efficient and reliable than many known prior art safety devices.

The present disclosure also provides a safety device that comprises a back-up system for blocking of the activation element when a blocking protuberance of the blocking element is too late to block the activation element.

To this end, the present disclosure relates to a safety device for a vehicle door handle, the device comprising:

an activation element configured to activate a latch by rotating around an activation axis from a rest position to an activation position, the activation element comprising at least one activation protuberance, a blocking element comprising first and second blocking protuberances and being configured to rotate around a blocking axis between a disengaged position in which the blocking element allows the activation element to rotate around the activation axis from a rest position to an activation position, a first blocking position in which the first blocking protuberance interacts with the activation protuberance so as to block the activation element in a first intermediate position disposed between the rest and activation positions of the activation element, and a second blocking position in which the second blocking protuberance interacts with the activation protuberance so as to block the activation element in an intermediate position disposed between the rest and activation positions of the activation element, and, wherein in case of a crash, the blocking element rotates around the blocking axis from the disengaged position to the first or the second blocking position depending on the rotation made by the activation element.

Advantageously, the safety device of the present disclosure comprises a second blocking protuberance configured to block the activation element in case the activation element rotates more quickly than the blocking element. This improves in a simple and not costly manner the efficiency and the reliability of the safety device.

According to further forms of the present disclosure, which can be considered alone or in combination:

the first blocking protuberance is configured for blocking the activation protuberance of the activation element at a rotation angle of the blocking element lower than the one in case of blocking the activation protuberance of the activation element by the second blocking protuberance with respect to the movement of the activation protuberance; and/or the first blocking protuberance has a radial length greater than the second blocking protuberance; and/or the blocking protuberances extend according to a plane substantially perpendicular to the blocking axis; and/or the blocking element comprises an inertial mass configured to make the blocking element rotate, in case of a crash, from the disengaged position to the first or the second blocking positions; and/or the first and second blocking protuberances define a recess for receiving the activation protuberance when the said activation protuberance is blocked by the second blocking protuberance; and/or the activation axis is substantially parallel to the blocking axis.

The present disclosure further relates to a vehicle door handle comprising a safety device and a handle grip comprising a gripping part and a column projecting from the gripping part, wherein the column cooperates with the activation element to drive the activation element from the rest position to the activation position.

According to further forms of the present disclosure, which can be considered alone or in combination:

the handle grip is rotationally mounted about a grip axis; and/or the grip axis is substantially parallel to the activation axis; and/or the grip axis is substantially parallel to the blocking axis; and/or the blocking axis is substantially placed between the activation axis and the grip axis.

According to another aspect, the present disclosure relates to a vehicle comprising a vehicle door handle.

Further areas of applicability will become apparent from the description provided herein. It should be understood that the description and specific examples are intended for purposes of illustration only and are not intended to limit the scope of the present disclosure.

DRAWINGS

In order that the present disclosure may be well understood, there will now be described various forms thereof, given by way of example, reference being made to the accompanying drawings, in which.

Figure 2:
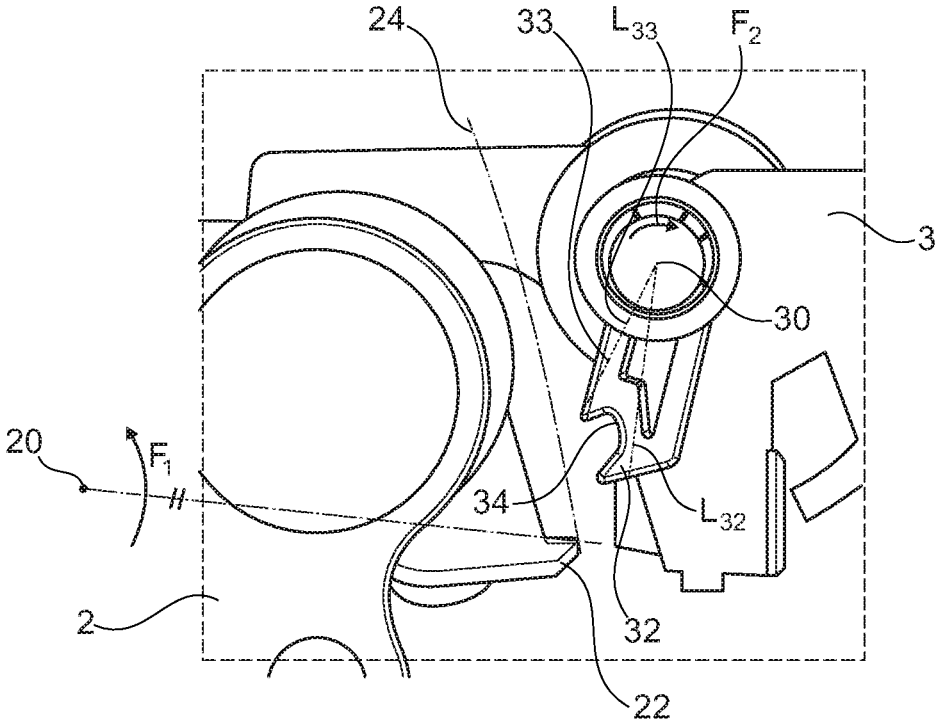
FIG. 2 is a side view of the activation element and of the blocking element, in which the activation element is in a rest position, according to the teachings of the present disclosure.
Figure 3:
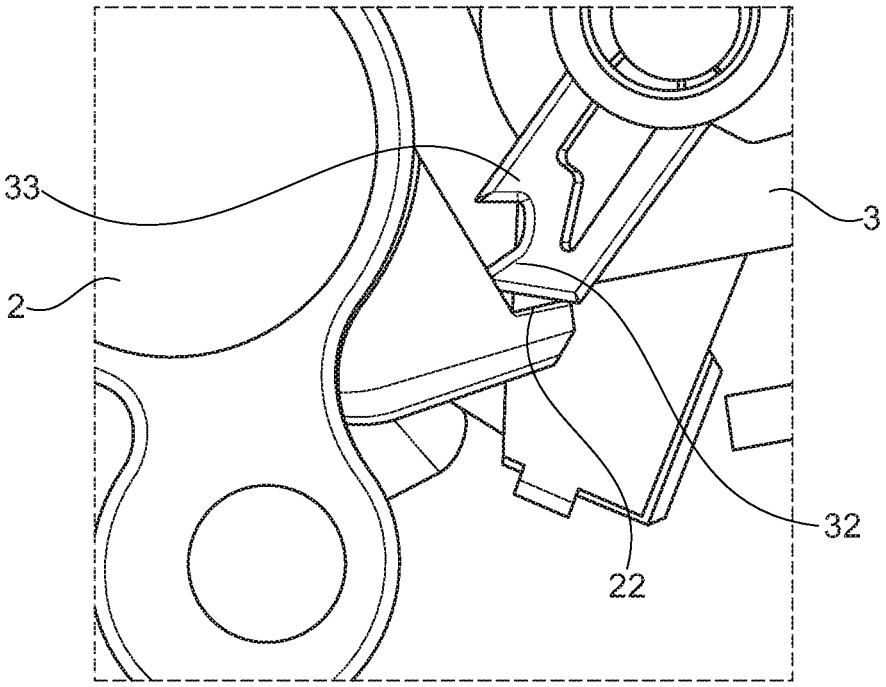
Figure 4:
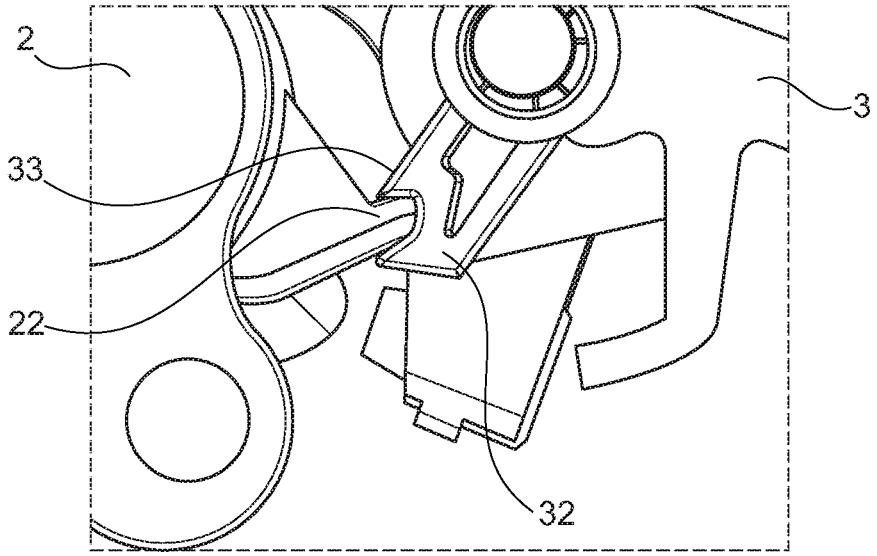

FIG. 3 is a side view according to FIG. 2, in which an activation protuberance of the activation element is blocked by a first protuberance of the blocking element, according to the teachings of the present disclosure; and FIG. 4 is a side view according to FIGS. 2 and 3, in which the activation protuberance is blocked by a second protuberance of the blocking element, according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
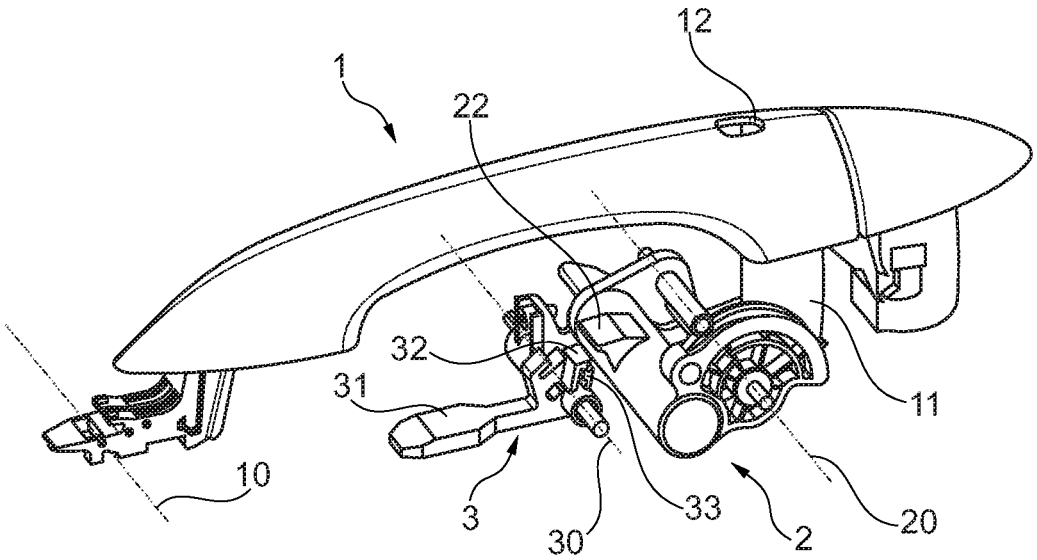
FIG. 1 is a perspective view of a vehicle handle, according to the teachings of the present disclosure.

Referring to FIG. 1, the vehicle door handle of the present disclosure may comprise a handle grip 1 which may comprise a gripping part 12 and a column 11 projecting from the gripping part 12. The handle grip 1 may be rotationally mounted about a grip axis (10).

The vehicle door handle of the present disclosure also comprises a safety device.

The safety device of the present disclosure comprises an activation element 2 configured to activate a latch (not shown) by rotating around an activation axis 20 from a rest position to an activation position, the activation element 2 comprising at least one activation protuberance 22.

The column 11 is connected to the activation element 2 such that when the handle is actuated by a user, the column 11 drives the activation element 2 from a rest position to an activating position. When the activation element 2 is moved to the activation position, it activates a latch such that the door can be opened. The activation element 2 may be connected to the latch by a cable, for example a Bowden cable.

The safety device of the present disclosure further comprises a blocking element 3 configured to block the activation element 2 in case of a crash.

The blocking element 3 comprises first and second blocking protuberances 32 and 33. The first and second blocking protuberances 32 and 33 are distinct from each other. The blocking element 3 is configured to rotate around a blocking axis 30 between a disengaged position and a first and second blocking positions.

In the disengaged position, the blocking element 3 allows the activation element 2 to rotate around the activation axis 20 from the rest position to the activation position.

In the first blocking position shown in FIG. 3, the first blocking protuberance 32 of the blocking element 3 interacts with the activation protuberance 22 of the activation element 2 so as to block the activation element 2 in a first intermediate position disposed between the rest and activation positions of the activation element 2.

In the second blocking position shown in FIG. 4, the second blocking protuberance 33 of the blocking element 3 interacts with the activation protuberance 22 of the activation element 2 so as to block the activation element 2 in an intermediate position disposed between the rest and activation positions of the activation element 2. The second blocking protuberance 22 is different from the first blocking position.

The safety device is configured such that in case of a crash, inertia of the handle parts may cause the activation element 2 to rotate around the blocking axis 30 from the disengaged position to the first or the second blocking position depending on the rotation made by the activation element 2. For example, activation element 2 may rotate in a direction, such as a counterclockwise direction F1 as shown in FIG. 2 towards the activation position. The same inertia may also cause the blocking element 3 to rotate in another direction, as such as the clockwise direction F2 as shown in FIG. 2 from the disengaged position to the first or the second blocking position.

Depending on various circumstances such as the initial state of the blocking element 3 and of the activation element 2 as well as the strength and the kind of acceleration undergone by the handle of the present disclosure, the first blocking protuberance 32 may be late to block the activation protuberance 22, such that the activation element 2 is moved toward the activation position and the door is opened. The second blocking protuberance 33 is configured to block the activation protuberance 22 if the first protuberance is late to block the activation protuberance 22 of the activation element 2.

Advantageously, the arrangement of the present disclosure enables to have an early blocking made by the first blocking protuberance 32 when the blocking element 3 is early to move before the activation element 2 in case of a crash. The arrangement of the present disclosure also enables to have a late blocking made by the second blocking protuberance 33 when the blocking element 3 is late to move before the activation element 2 in said case of a crash.

Advantageously, the second blocking protuberance 33 enables to have a second distinct and separate blocking position, thereby increasing the safety of the handle in case of a side crash when the first protuberance 32 of the blocking element 3 is late to block the activation protuberance of the activation element 2.

According to another form of the present disclosure, the first blocking protuberance 32 is configured for blocking the activation protuberance 22 of the activation element 2 at a rotation angle of the blocking element 3 lower than the one in case of blocking the activation protuberance 22 of the activation element 2 by the second blocking protuberance 33 with respect to the movement of the activation protuberance 22. In particular, the first blocking protuberance 32 is configured to block the activation protuberance 22 at a lower position with reference to FIGS. 2 and 3, with respect to the second blocking protuberance 33.

According to yet another form of the present disclosure, the first blocking protuberance 32 has a radial length $L_{32}$ greater than the one $L_{33}$ of the second blocking protuberance 33. The radial length is measured with respect to the blocking axis 30. The length of the blocking protuberances 32, 33 enables a quick and a late blocking of the activation protuberance 22.

According to at least one form of the present disclosure, the blocking protuberances 32, 33 extend according to a plane substantially perpendicular to the blocking axis 30. Coplanar blocking protuberances limit the space requirement of the blocking protuberances.

According to one form of the present disclosure, the blocking element 3 comprises an inertial mass 31 configured to make the blocking element 3 rotate, in case of a crash, from the disengaged position to the first or the second blocking positions.

The blocking element 3 may also be moved by an electronic system sensing the crash.

According to a form of the present disclosure, the first and second blocking protuberances 32, 33 define a recess for receiving the activation protuberance 22 when the said activation protuberance 22 is blocked by the second blocking protuberance 33. The recess improves the maintaining of the activation protuberance in the second blocking position. The recess enables also a minimum overlapping between the activation protuberance 22 and the second blocking protuberance 33 during blocking.

The safety device, in one form of the present disclosure, comprises a link member 34 linking the blocking protuberances 32 and 33 together. The link member 34 provides that the blocking protuberances 32 and 33 are very close to the path done by activation protuberance 22 during the movement (shown by line 24 in FIG. 2).

In particular, the link member 34 forms the recess receiving the activation protuberance 22.

The recess enables a reduced overlapping between the activation protuberance 22 and blocking protuberance 33 during the blocking.

According to another form of the present disclosure, the activation axis 20 is substantially parallel to the blocking axis 30. Advantageously, parallel activation and blocking axes 20, 30 simplify the blocking as the protuberances are moved in a common plane in the same direction.

According to at least one form of the present disclosure, the handle grip 1 is rotationally mounted about a grip axis 10, which is substantially parallel to the activation axis 20. Advantageously, parallel grip and activation axes 10, 20 limit the space requirement of the activation protuberance 22 as the latter may be aligned with a longitudinal handle grip 1.

According to yet another form of the present disclosure, the grip axis 10 is substantially parallel to the blocking axis 30. Advantageously, parallel grip and blocking axes 10, 30 limit the space requirement of the blocking protuberances 32, 33 as the latter may be aligned with a longitudinal handle grip 1.

According to a form of the present disclosure, the blocking axis 30 is substantially placed between the activation axis 20 and the grip axis 10 as shown in FIG. 1. Such an arrangement improves the space allowed for the safety device by placing the blocking element 3 and the activation element 2 at one side of the column 12, and to leave some space for a lock another side of the column.

The present disclosure has been described above with the aid of various exemplary forms without limitation of the general inventive concept as defined in the claims.

Many modifications and variations will suggest themselves to those skilled in the art upon making reference to the foregoing illustrative forms, which are given by way of example only and which are not intended to limit the scope of the present disclosure, that being determined solely by the appended claims.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A safety device for a vehicle door handle comprising:

an activation element configured to activate a latch by rotating around an activation axis from a rest position to an activation position, the activation element comprising at least one activation protuberance; and a blocking element comprising first and second blocking protuberances and being configured to rotate around a blocking axis between:

a disengaged position in which the blocking element allows the activation element to rotate around the activation axis from a rest position to an activation position, a first blocking position in which the first blocking protuberance interacts with the activation protuberance so as to block the activation element in a first intermediate position disposed between the rest and activation positions of the activation element, and a second blocking position in which the second blocking protuberance interacts with the activation protuberance so as to block the activation element in a second intermediate position, distinct from the first intermediate position, disposed between the rest and activation positions of the activation element, and, wherein in case of a crash, the blocking element rotates around the blocking axis from the disengaged position to the first or the second blocking position depending on the rotation made by the activation element, and wherein the first and second blocking protuberances define a recess for receiving the activation protuberance when the said activation protuberance is blocked by the second blocking protuberance.

2. The safety device according to claim 1, wherein the first blocking protuberance is configured for blocking the activation protuberance of the activation element at a rotation angle of the blocking element lower than the one in case of blocking the activation protuberance of the activation element by the second blocking protuberance with respect to the movement of the activation protuberance.

3. The safety device according to claim 2, wherein the first blocking protuberance has a radial length greater than the second blocking protuberance.

4. The safety device according to claim 1, wherein the blocking protuberances extend according to a plane substantially perpendicular to the blocking axis.

5. The safety device according to claim 1, wherein the blocking element comprises an inertial mass configured to make the blocking element rotate, in case of a crash, from the disengaged position to the first or the second blocking positions.

6. The safety device according to claim 1, wherein the activation axis is substantially parallel to the blocking axis.

7. A vehicle door handle comprising the safety device according to claim 1, and a handle grip comprising a gripping part and a column projecting from the gripping part, wherein the column cooperates with the activation element to drive the activation element from the rest position to the activation position.

8. The vehicle door handle according to claim 7, wherein the handle grip is rotationally mounted about a grip axis.

9. The vehicle door handle according to claim 8, wherein the grip axis is substantially parallel to the activation axis.

10. The vehicle door handle according to claim 9, wherein the grip axis is substantially parallel to the blocking axis.

11. The vehicle door handle according to claim 9, wherein the blocking axis is substantially placed between the activation axis and the grip axis.

12. A vehicle comprising the vehicle door handle according to claim 7.

13. A vehicle door handle comprising:

a safety device comprising:

an activation element configured to activate a latch by rotating around an activation axis from a rest position to an activation position, the activation element comprising at least one activation protuberance; and a blocking element comprising first and second blocking protuberances and being configured to rotate around a blocking axis between:

a disengaged position in which the blocking element allows the activation element to rotate around the activation axis from a rest position to an activation position, a first blocking position in which the first blocking protuberance interacts with the activation protuberance so as to block the activation element in a first intermediate position disposed between the rest and activation positions of the activation element, and a second blocking position in which the second blocking protuberance interacts with the activation protuberance so as to block the activation element in a second intermediate position, distinct from the first intermediate position, disposed between the rest and activation positions of the activation element, and, wherein in case of a crash, the blocking element rotates around the blocking axis from the disengaged position to the first or the second blocking position depending on the rotation made by the activation element;

a handle grip comprising a gripping part and a column projecting from the gripping part, wherein the column cooperates with the activation element to drive the activation element from the rest position to the activation position, wherein the handle grip is rotationally mounted about a grip axis, wherein the grip axis is substantially parallel to the activation axis, wherein the blocking axis is substantially placed between the activation axis and the grip axis.

* * * * *